US009662533B2

(12) United States Patent
Colan et al.

(10) Patent No.: US 9,662,533 B2
(45) **Date of Patent: *May 30, 2017**

(54) SELF-COMPENSATING TIRE COMPRESSION TRAINER

(71) Applicant: SportCrafters, Inc., Granger, IN (US)

(72) Inventors: Peter V Colan, Elkhart, IN (US); Patrick T Kulwicki, South Bend, IN (US)

(73) Assignee: SportCrafters, Inc., Granger, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/235,776

(22) Filed: Aug. 12, 2016

(65) Prior Publication Data

US 2016/0346591 A1 Dec. 1, 2016

Related U.S. Application Data

(63) Continuation of application No. 14/828,888, filed on Aug. 18, 2015, now Pat. No. 9,486,687.

(60) Provisional application No. 62/040,682, filed on Aug. 22, 2014.

(51) Int. Cl.

| | |
|---|---|
| ***A63B 21/00*** | (2006.01) |
| ***A63B 21/22*** | (2006.01) |
| ***A63B 69/16*** | (2006.01) |
| ***A63B 23/04*** | (2006.01) |
| ***A63B 21/005*** | (2006.01) |

(52) U.S. Cl.
CPC ..... *A63B 21/225* (2013.01); *A63B 21/0051* (2013.01); *A63B 21/00192* (2013.01); *A63B 23/0476* (2013.01); *A63B 69/16* (2013.01); *A63B 2069/164* (2013.01); *A63B 2069/165* (2013.01)

(58) Field of Classification Search
USPC ..... 482/1–148
See application file for complete search history.

(56) References Cited

U.S. PATENT DOCUMENTS

| | | | | |
|---|---|---|---|---|
| 2,972,478 A * | 2/1961 | Raines | A63B 69/16 211/22 |
| 3,724,844 A * | 4/1973 | Olmstead | A63B 69/16 211/22 |
| 5,031,901 A * | 7/1991 | Saarinen | A63B 21/0051 310/191 |
| 5,382,208 A * | 1/1995 | Hu | A63B 21/0051 482/61 |
| 5,433,681 A * | 7/1995 | Minoura | A63B 21/0051 482/61 |

(Continued)

*Primary Examiner* — Stephen Crow
(74) *Attorney, Agent, or Firm* — Botkin & Hall, LLP

(57) ABSTRACT

A self-compensating tire compression device is provided for use with a trainer. The device attaches to a frame, such as a bicycle, that holds the axis of a driving wheel fixed. The device has a pivoting portion that presses a driven portion of a resistance device against the driving wheel. The pivoting point of the pivoting portion is located on the trainer to provide a static contact pressure between the driving wheel and the driven wheel, and when the driving wheel begins to rotate and the resistance device begins to resist the rotation, the contact pressure between the driving wheel and the driven wheel increases to prevent slippage between the two wheels.

5 Claims, 7 Drawing Sheets

(56) References Cited

U.S. PATENT DOCUMENTS

| | | | | | |
|---|---|---|---|---|---|
| 5,545,982 | A * | 8/1996 | Vlakancic | B62L 1/12 | 188/24.22 |
| 5,628,711 | A * | 5/1997 | Boucher | A63B 69/16 | 434/61 |
| 5,916,067 | A * | 6/1999 | Morasse | A63B 69/16 | 482/61 |
| 7,011,607 | B2 * | 3/2006 | Kolda | A63B 21/0051 | 482/57 |
| 7,226,395 | B2 * | 6/2007 | Wu | A63B 69/16 | 280/293 |
| 7,314,434 | B2 * | 1/2008 | Chen | A63B 21/0051 | 188/164 |
| 7,326,151 | B2 * | 2/2008 | Peterson | A63B 22/16 | 482/57 |
| 7,530,933 | B2 * | 5/2009 | Chen | A63B 21/0051 | 482/61 |
| 7,766,798 | B2 * | 8/2010 | Hamilton | A63B 24/0087 | 434/61 |
| 7,955,228 | B2 * | 6/2011 | Hamilton | A63B 24/0087 | 482/61 |
| 9,486,687 | B2 * | 11/2016 | Colan | A63B 69/16 | |
| 2006/0229163 | A1 * | 10/2006 | Waters | A63B 22/0605 | 482/8 |
| 2011/0275488 | A1 * | 11/2011 | Hamilton | A63B 24/0087 | 482/61 |

* cited by examiner

SELF-COMPENSATING TIRE COMPRESSION TRAINER

CROSS REFERENCE TO RELATED APPLICATIONS

This application is a continuation of and claims the benefit of priority from the prior U.S. patent application Ser. No. 14/828,888 filed on Aug. 18, 2015, which claims the benefit of U.S. Provisional Application No. 62/040,682, filed Aug. 22, 2014, the disclosures of which are hereby incorporated by reference.

BACKGROUND OF THE INVENTION

Stationary bicycle trainers have been popular in the last few decades as a means to use an existing bicycle on a stationary device that provides resistance to pedaling without the need to also balance, as is required with a bicycle roller.

In the current art, most bicycle trainers and a variety of resistance mechanisms, that rely on the bicycle's own tire to drive a resistance device, use a framework to rigidly mount the rear wheel while holding the bicycle upright. In all of these applications, the resistance mechanism is located behind the rear wheel and pivotally attached to the framework below the resistance device, or "upstream" of the tire's direction of rotation. This is a convenient place to locate a pivot, and allows the driven cylinder of the resistance mechanism to be adjusted into the tire to a degree that reduces or eliminates slippage at the highest torque the cyclist can put out. This method of compressing a driven cylinder into the bicycle tire will be referred to as "Fixed Compression" herein.

For example; for a cyclist to put out a maximum of 700 watts the resistance device must compress the rear tire sufficiently to prevent slipping. Realistically, however, most of the time a user will spend on a trainer is at much lower wattage, such as 150 to 200. Therefore, most of the time the tire is compressed and distressed unnecessarily.

This causes three problems; A) the tire will wear quickly if it is highly distressed. In fact, many manufacturers make a special "trainer tire" that is a harder rubber compound capable of lasting longer in trainers. These tires cannot be used on the road because their hard composition causes reduced coefficient of friction to a road surface and is relatively easy for a cyclist to lose control. B) high distress at low power consumes power that limits the minimum effort for the cyclist and C) high distress with no power input consumes inertia from relatively light bicycle wheels, requiring heavier flywheels to compensate for the loss. Bicycle trainer manufacturers typically design for a certain degree of inertia to provide for a smooth stroke since it is nearly impossible to power through a 360 degree pedal rotation with constant power. Uneven power application will cause exaggerated changes in wheel speed, especially with lightweight bicycle wheels unless a heavier flywheel (integral to the bicycle trainer) is employed to better control wheel speed, acceleration, and deceleration. An improved tire compression device is needed.

SUMMARY OF THE INVENTION

The resistance mechanism is mounted to the framework, allowing it to pivot "downstream" of the tire's rotation. By doing this, the tangential force on the resistance mechanism (caused by the frictional interface between the tire and the driven cylinder) translates to a rotational force about the pivot of the resistance mechanism pivot arm which drives the driven cylinder harder against the tire. The intent of the design is that the pivot point will be strategically positioned so that the ratio of normal force to tangential force matches or exceeds the coefficient of friction between the tire and the driven cylinder, in which case the tire will never slip and a minimal amount of normal force is necessary by the application of a spring to maintain contact with the tire with little to no power load from the cyclist. This will be referred to as "Automatic Compression" herein.

An alternative embodiment is also proposed which has several advantages: A) a smaller flywheel can be used because the speed of the flywheel can be increased as compared to the speed of the driven cylinder by using different pulley or sprocket diameters between the driven cylinder and the resistance mechanism. A smaller flywheel may be desired to reduce the overall weight and cost of the device. B) Moving the mass to the pivot center of the pivot arm reduces the overall moment of inertia of the pivot arm assembly, comprising the pivot arm, driven cylinder, resistance mechanism, and associated components. Reducing the moment of inertia makes the pivot arm more responsive to sudden changes in speed of the bicycle wheel, further avoiding any potential for slippage between the bicycle tire and the driven cylinder.

BRIEF DESCRIPTION OF THE DRAWINGS

A preferred embodiment of this invention has been chosen wherein.

DESCRIPTION OF THE PREFERRED EMBODIMENT

Figure 1:
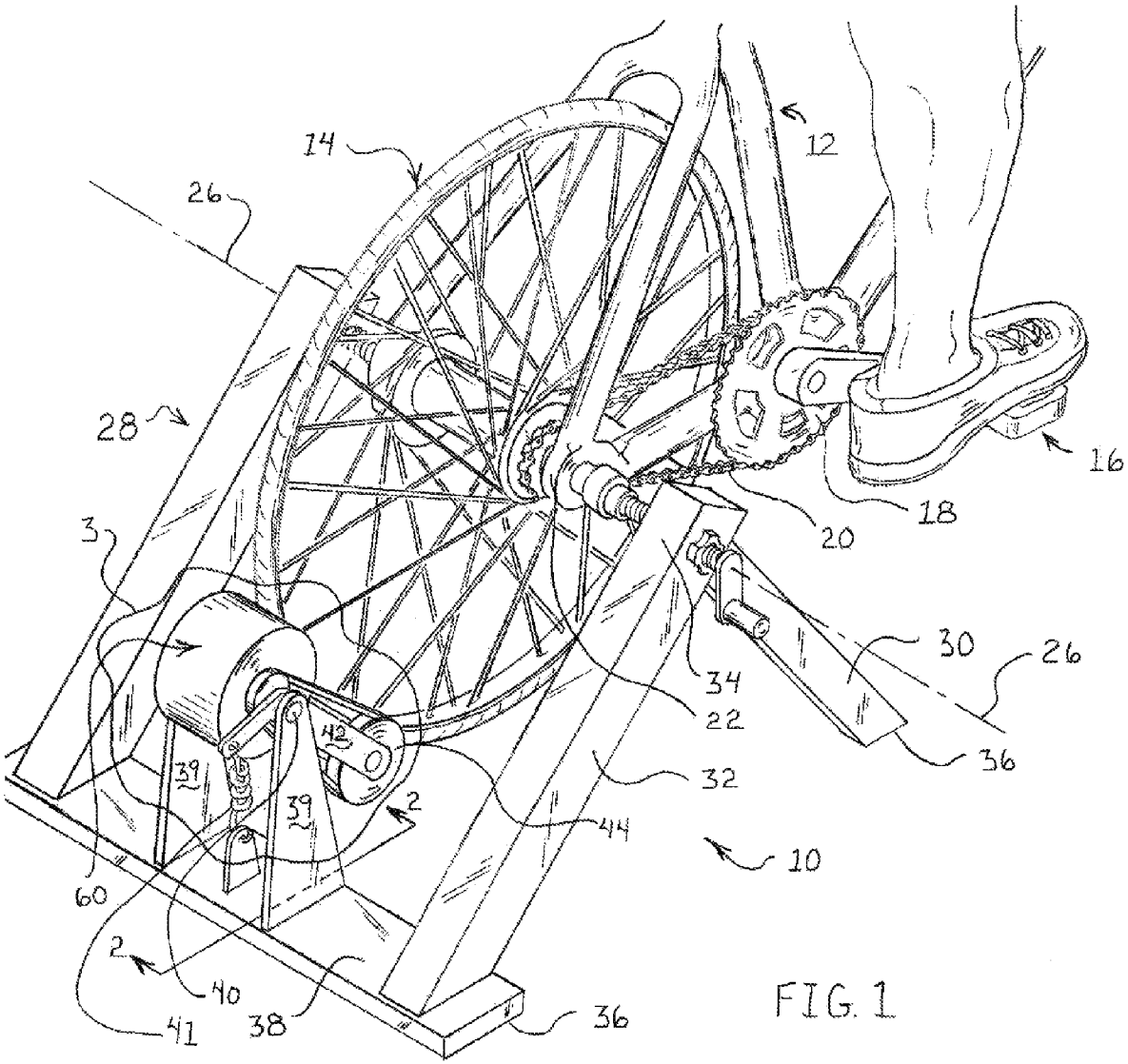
FIG. 1 is an isometric side view of the system as mounted to a bicycle.

An automatic or self-compensating tire compression bicycle trainer system 10 as shown in FIG. 1 is designed to be attached to the rear axle of a typical bicycle 12. As is commonly known in the art, a rear wheel 14 is driven by a crank 16 through a chain 20 and series of sprockets. As the user rotates the crank 16, the driving gear 18 pulls on the chain 20. Movement of the chain 20 causes the rear sprocket 22 to begin turning. The rear sprocket 22 drives the rear wheel 14 about the driving axis 26. Attached to the rear wheel 14 and forming the outermost diameter is a rear tire 24, FIG. 2. Tires on most bicycles are pneumatic, meaning that air pressure internal to the tire causes the tire to maintain its shape. The air also acts as a cushion to absorb surface irregularities and allows the user to adjust ride quality by increasing or decreasing the pressure.

Figure 2:
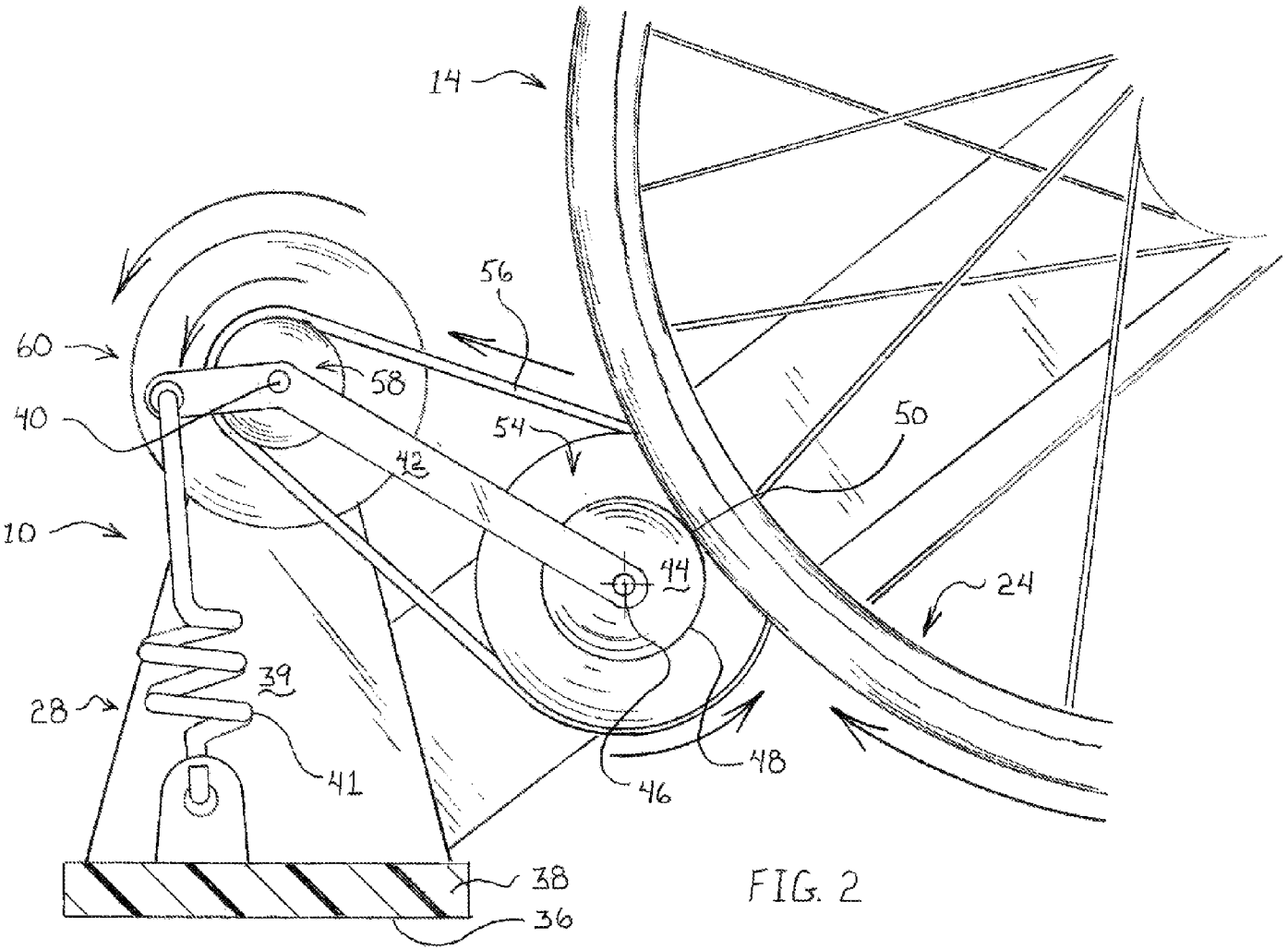
FIG. 2 is a side view section 2-2 of the system in FIG. 1.
Figure 4:
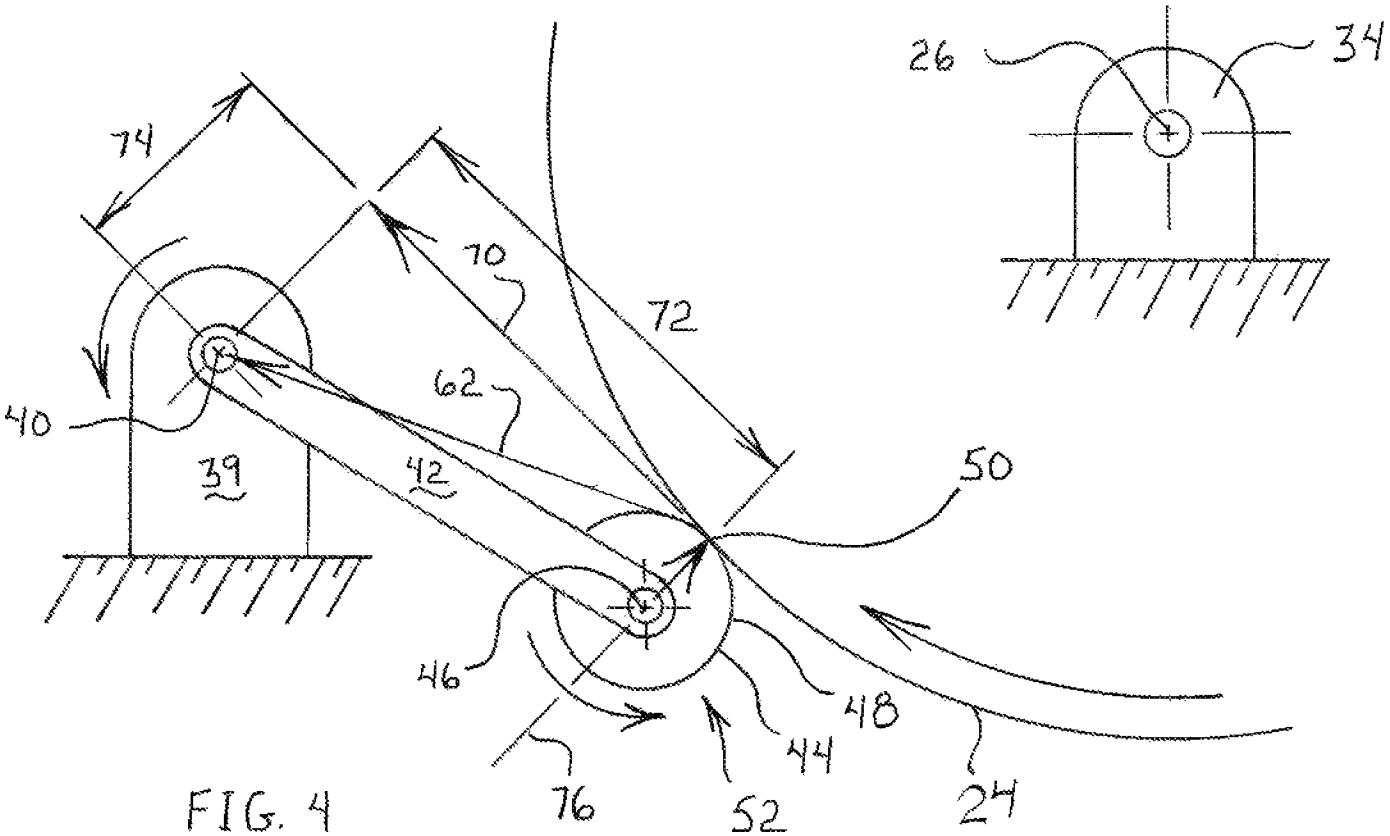
FIG. 4 is a simplified partial schematic side view showing the forces and mounting points of the system.

The system 10, as shown in FIG. 1, is made up of a frame 28 with a front stabilizing portion 30, a rear portion 32 with a bridge portion 38, and an axle mounting portion 34. The front stabilizing portion 30 and the bridge portion 38 have a lower surface 36 which is designed to rest on the ground. Since gyroscopic forces on both wheels assist the user in maintaining balance on the bike, a trainer where one wheel is stationary requires the bicycle 12 be held upright and fixed from movement to the frame 28 as is shown in FIG. 1. The portions 30 and 32 connect at the mounting portion 34. As shown in FIG. 1, the bridge portion 38 has a resistance mounting portion 39 that holds a resistance device 60. The mounting portion 34 is adapted to attach to the rear axle of the bicycle 12. The frame 28 is shown attaching directly to the rear axle but it is contemplated that the device could attach to any portion of the frame of the bicycle. As shown in FIG. 2, the resistance mounting portion 39 has a pivot point 40 where a pivot arm 42 rotates. The pivot arm 42 includes a driven cylinder 44 that rotates about a driven axis 46. The driven cylinder 44 has an outside diameter 48 where it contacts the outside surface of the rear tire 24 at a contact point 50. As shown in FIG. 4, the contact point 50 is tangent to both the rear tire 24 and the driven cylinder 44.

Figure 6:
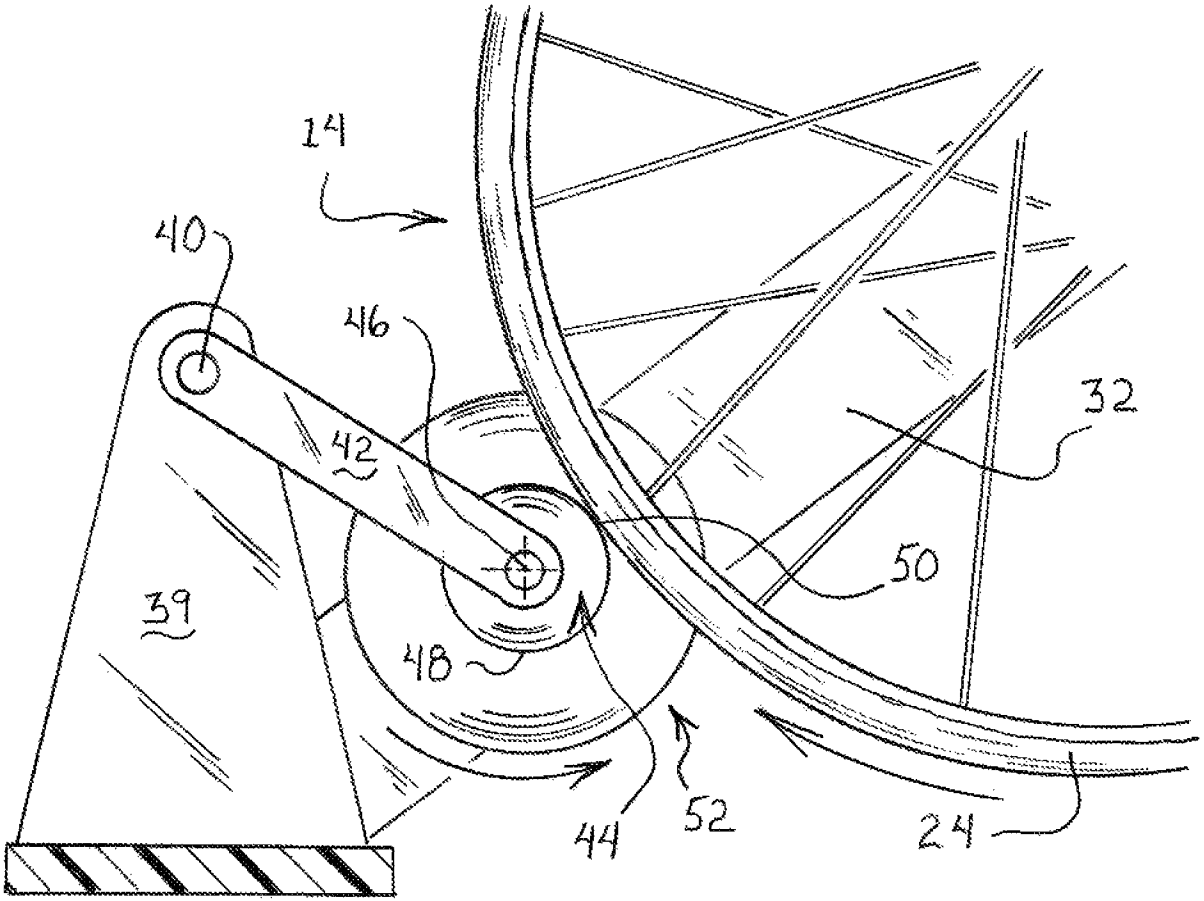
FIG. 6 is a partial schematic side view of an alternate embodiment of the system.
Figure 7:
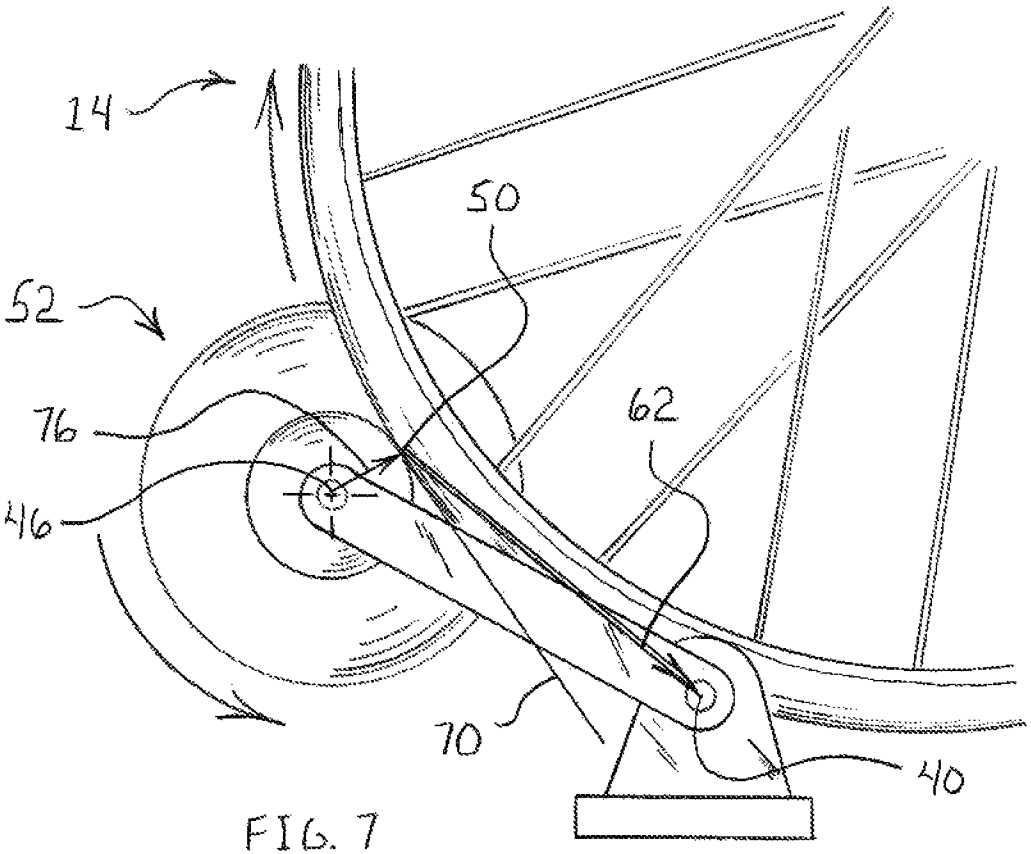
FIG. 7 is a partial schematic side view of an alternate embodiment of the system.

In one embodiment, the driven cylinder 44 is a resistance device 52 as is shown in FIGS. 4, 6, and 7. The resistance device 52 rotates about the driven axis 46 and resists rotation. The resistance device 52 can use different methods to resist rotation. It is desired that the resistance device 52 increases resistance as the rotational speed increases. One style involves eddy currents (shown in FIG. 3), which use magnets 51 in proximity to a metal (usually aluminum) drum. Another option uses viscous fluid, friction material 53, or other mechanical means. Other options involve fans or a combination of the previously mentioned styles. In the eddy current drive, magnets 51 ride on a carrier that may be eccentric to the driven axis 46. As the outside cylinder rotates, magnets that ride on the internal carrier generate eddy currents in the outside cylinder. In this embodiment, a progressive resistance device is used where the outside cylinder is typically the outside diameter 48 of the resistance device 52. As the eddy currents increase in the cylinder, the drag force created pulls the magnets about the offset axis, causing them to become closer to the drum, and therefore further increasing the drag. The offset axis is spring loaded to allow the offset axis to return the magnets back to a nominal position inside the drum. The eddy current resistance mechanism is known in the art and the subject of other utility patents. It is contemplated that the resistance is located on the driven axis 46 but offset to the side to allow for clearance or increased size without requiring a taller frame 28.

Figure 3:
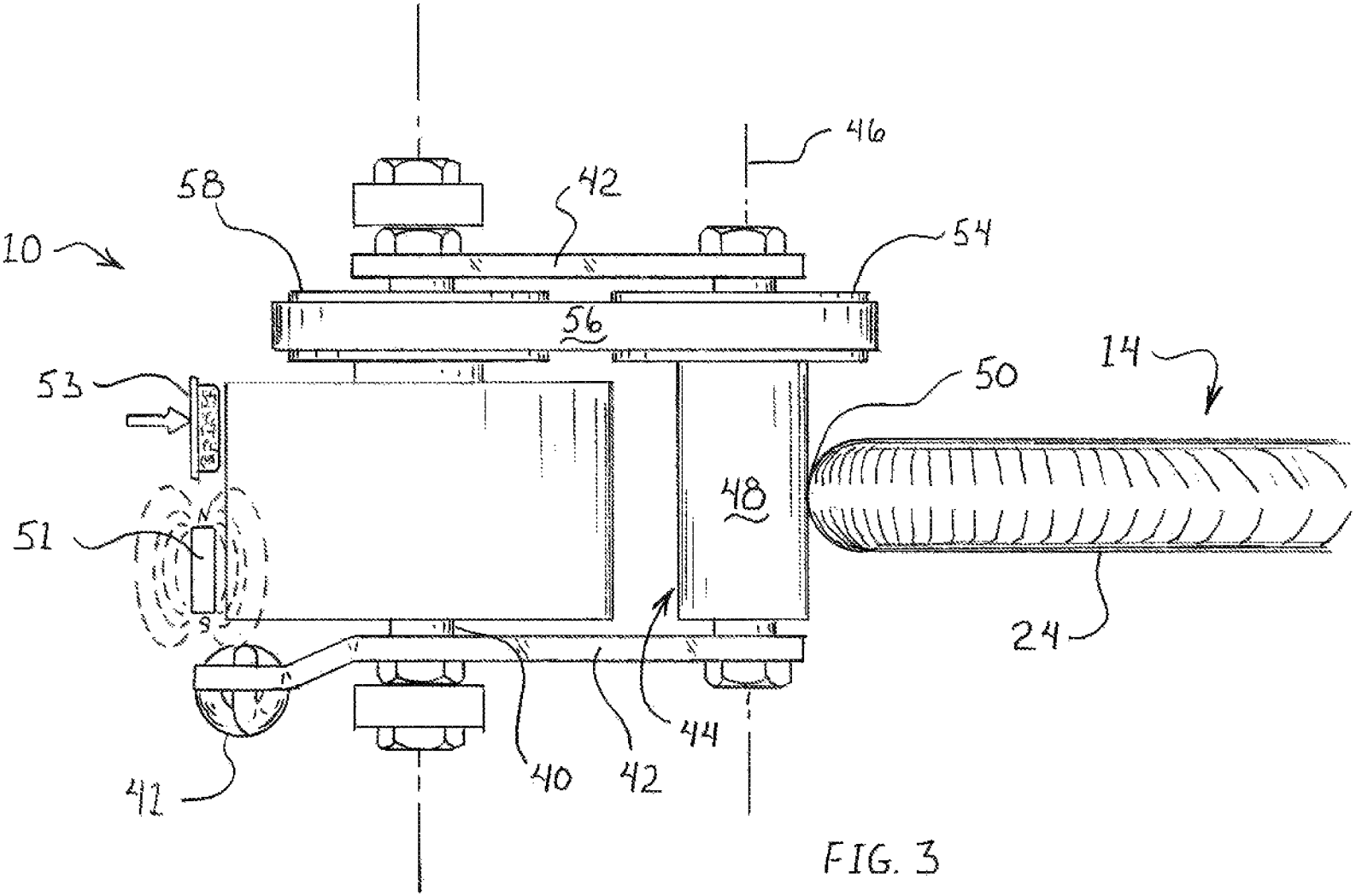
FIG. 3 is a top view of partial section 3 of the system in FIG. 1.

In another embodiment, the driven cylinder 44 contains no resistance device but contains a pulley or sprocket 54, FIGS. 2 and 3 that drives a belt or chain 56, which in turn drives another pulley or sprocket 58 which is attached to the resistance device 60. As stated previously, resistance devices are well known in the art of bicycle trainers. The driven cylinder 44 typically would have a lower mass or rotational inertia than a normal resistance device. The driven cylinder 44 drives a chain or belt 56 to the resistance device mounted at or close to the pivot point of the pivot arm. Using different sized pulleys or sprockets, as is shown in FIGS. 2-3, the ratio between the driven cylinder and the resistance device can be multiplied or divided. The separate resistance device allows the system to be more responsive to sudden changes in the rotational speed of the wheel 24.

The outside diameter 48 is held in biased contact with the outside surface of the tire 24 via a spring 41. The spring 41 holds the pivot arm 42 with enough static force (shown as normal force 76 in FIG. 4) for the tire 24 to begin rotating against the driven cylinder 44 without slippage. The spring 41 is shown in FIG. 1 and removed in other FIGS. for simplicity. As shown, the spring 41 applies tension to a portion of the pivot arm 42 to bias the outside diameter 48 wheel 14. It is contemplated that the spring 41 is implemented in compression to accomplish the same task. It is further contemplated that a balancing mechanism is implemented instead of a spring in order to maintain biased contact at contact point 50.

As shown in FIG. 4, the tire 24 increasing in speed causes the driven cylinder 44 to create drag by resisting rotation. It either creates drag directly or has drag created by another driven device. This drag creates a line of applied force 62 that travels from the contact point 50 to the pivot point 40. This is shown in FIG. 4 as applied force 62. Because the pivot point 40 is not located on the tangent line or the normal force line, the applied force 62 is split into a tangent force 70 and a normal force 76. The normal force 76 is increased as a proportion of the force 62. If the pivot point 40 was intersected by the tangent force 70, the normal force 76 would remain the same regardless of the drag in the system. If the pivot point 40 was intersected by the normal force 76, the driven cylinder 44 would be simply pushed out of the way as the tire 24 rotates.

Figure 5:
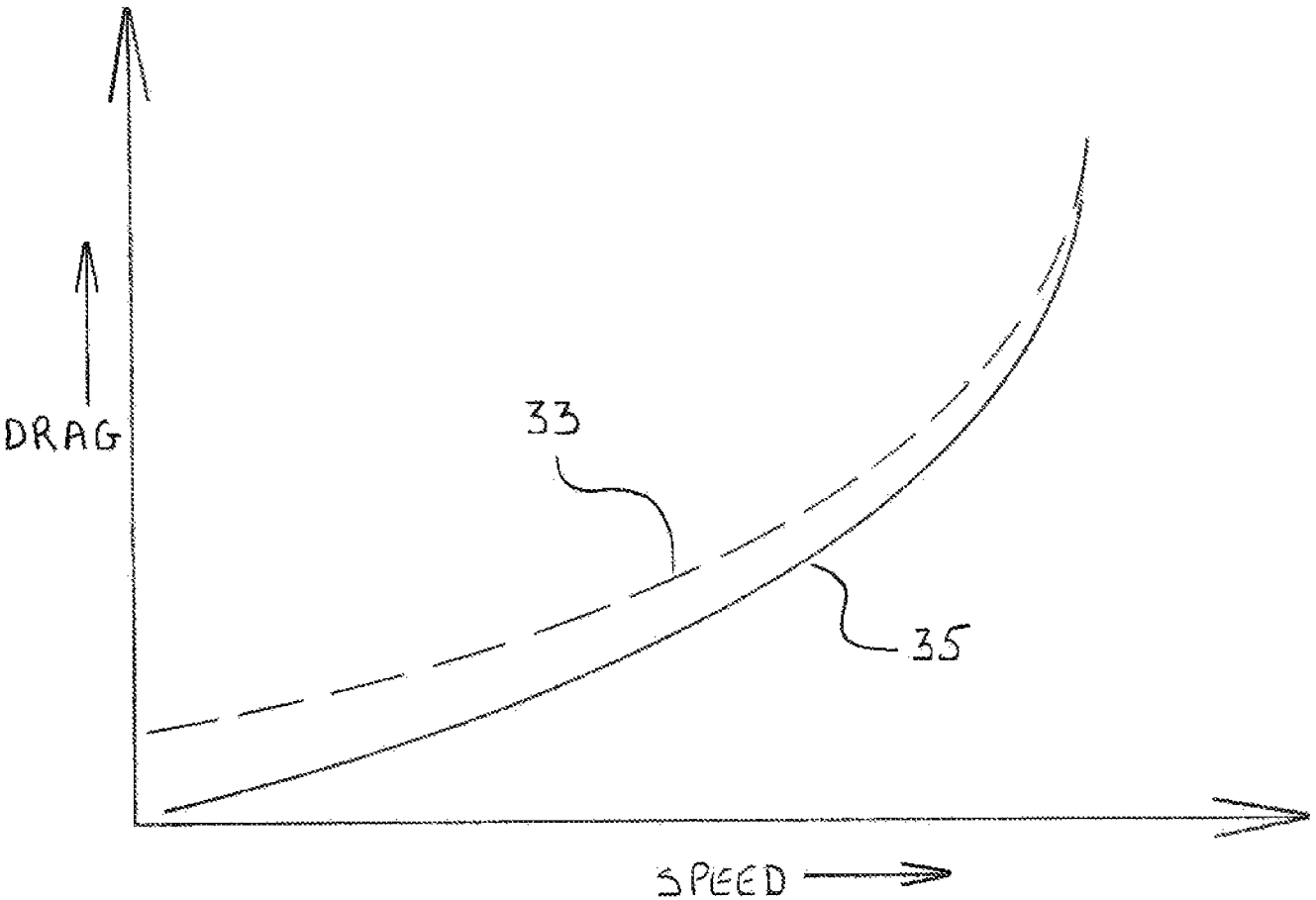
FIG. 5 is a graph showing the power vs speed for fixed and automatic compression.

As is shown in FIG. 5, drag and torque are directly related. The tangential force 70 creates a moment about the pivot point 40 of the pivot arm 42 calculated as tangential force*dimension 74. This moment is reacted by the normal force*dimension 72. These two forces are constrained to be equal, so tangential force*dimension 74=normal force*dimension 72. This can be rewritten as dimension 72/dimension 74=Tangential force/Normal force. The coefficient of friction is the force required to move the two sliding surfaces over each other (tangential force), divided by the force holding them together, (normal force). So long as the ratio of tangential force to normal force remains lower than the coefficient of friction between the tire and the driven cylinder 44, the tire will not slip. This relationship also defines the relationship of dimension 72 to dimension 74. This is all visible in FIG. 4.

At rest, the normal force 76 from the driven cylinder 44 is from the spring 41. Once the driven cylinder 44 begins moving, the resistance device 52, 60 begins to cause drag in the system. The drag creates a force 62 that is a line that intersects the contact point 50 and the pivot point 40. Because the force 62 is at an angle to the tangential force 70 and the normal force 76, the force 62 resists the tangential force 70 created by the tire 24. The force is a compressive force between the pivot point and the point of contact between the outside surface 50 and the outside diameter 48 of the driven cylinder 44. The reaction force is split into two components, one of those components adds into the normal force 76. The moment as shown in FIG. 6 is counterclockwise when the wheel 14 is rotating clockwise. The moment as shown in FIG. 7 is counterclockwise when the wheel 14 is rotating clockwise.

The calculated effect of automatic compression versus fixed compression can be seen in the graphs shown in FIG. 5. With fixed compression 33, there is a predetermined amount of drag on the tread surface of the tire regardless of speed. At higher speeds it becomes irrelevant and matches the drag caused by automatic compression 35. At lower speeds, the automatic compression drag force is significantly reduced. The drag vs. speed graph is shown in FIG. 5.

One of the effects, as mentioned earlier, is to simulate the effect of a flywheel, where on the sudden application of high power the additional resistance caused by higher tire distress provides the same net effect as pushing against a flywheel.

Likewise, the sudden removal of power decreases tire distress and allows the wheel to spin more freely, also providing the same net effect as a flywheel.

The chart in FIG. 5 is drag vs. speed, assuming a resistance device is employed that provides non-linear power vs speed such as a typical fluid mechanism, or the progressive resistance device. The upper curve 33 is the drag that would be represented by a fixed compression device. The lower curve 35 represents the drag present by the automatic compression device. It allows for a more highly non-linear relationship of power and speed, which provides the designer of a training system more flexibility in tuning a power curve to suit the needs of the consumer.

As shown in FIGS. 1-4 and 6, the driven cylinder 44 or resistance device 60 is shown with the rotating tire causing a compressive force on the pivot arm 42. It is possible to accomplish the same tire compression compensation by relocating the pivot point 40 on the opposite side of the tangent line. This setup is shown in FIG. 7. In this embodiment, the pivot point 40 is located closer to the rotating axis of the rear tire 24. As the resistance device 52 begins to generate drag, the applied force 62 translates to a tangent force 70 and a normal force 76.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A self-compensating resistance trainer adapted for use with a cycling mechanism having a bicycle wheel, said bicycle wheel rotatable with respect to said cycling mechanism about a first rotational axis, said first rotational axis fixed with respect to said cycling mechanism, said trainer comprising:

a frame having a mounting portion adapted to releasably affix said first rotational axis of said cycling mechanism with respect to said frame;

a pivot arm being pivotably affixed to said frame about a pivot axis, a spring connected between said pivot arm and said frame, said spring urging a distal end of said pivot arm towards said mounting portion of said frame;

a resistance device having a central axle affixed to said distal end of said pivot arm parallel to and spaced from said pivot axis, said resistance device having a driven cylinder resisting rotation with respect to said central axle, when said first rotational axis of said cycling mechanism is affixed to said frame, said bicycle wheel contacts said driven cylinder at a contact point and imparts rotation thereto, said pivot arm urging said resistance device toward said mounting portion of said frame, said resistance device includes a magnet to generate said resistance when said driven cylinder rotates;

a spring generating a static biasing force at said contact point when said cycling mechanism is affixed to said mounting portion of said frame, said driven cylinder contacting and being urged toward said bicycle wheel by said static biasing force;

a mechanism generating a dynamic biasing force at said contact point increasing from a relatively low force when said bicycle wheel is stationary and increasing to a relatively high force when said bicycle wheel is rotating said driven cylinder in a first direction, said dynamic biasing force subtracting from said static biasing force when said bicycle wheel is rotating said driven cylinder in a direction opposite said first direction; and said dynamic biasing force being sufficient to prevent slippage between said driven cylinder and said bicycle wheel.

2. The trainer of claim 1, further comprising a tangent line extending tangentially from said bicycle wheel at said contact point and being substantially perpendicular to said first rotational axis, said bicycle wheel creating a tangent force vector extending along said tangent line when said bicycle wheel is rotating, said pivot axis spaced from said tangent line by a first distance so that said tangent force vector generates said dynamic biasing force.

3. The trainer of claim 1, wherein said pivot axis is located with respect to said contact point to create a moment that increases said biasing force upon increased resistance.

4. The trainer of claim 1, wherein said pivot axis is located farther from said first rotational axis than said contact point.

5. The trainer of claim 1, wherein said resistance device being a progressive resistance device.

* * * * *